US011083313B2

(12) United States Patent
Kash

(10) Patent No.: US 11,083,313 B2
(45) Date of Patent: Aug. 10, 2021

(54) SPLIT BED SKIRT

(71) Applicant: Tanya Kash, Las Vegas, NV (US)

(72) Inventor: Tanya Kash, Las Vegas, NV (US)

( * ) Notice: Subject to any disclaimer, the term of this patent is extended or adjusted under 35 U.S.C. 154(b) by 0 days.

(21) Appl. No.: 17/063,186

(22) Filed: Oct. 5, 2020

(65) Prior Publication Data

US 2021/0100381 A1 Apr. 8, 2021

Related U.S. Application Data

(60) Provisional application No. 62/910,612, filed on Oct. 4, 2019.

(51) Int. Cl.
*A47G 9/02* (2006.01)
*A47G 9/04* (2006.01)

(52) U.S. Cl.
CPC ..... *A47G 9/0292* (2013.01); *A47G 9/04* (2013.01)

(58) Field of Classification Search
CPC ..... A47G 9/04; A47G 9/0284; A47G 9/0292
See application file for complete search history.

(56) References Cited

U.S. PATENT DOCUMENTS 1,885,558 A * 11/1932 Smith ..... A47D 15/008 128/872
2,689,961 A * 9/1954 Lieberthal ..... A47G 9/023 5/486
3,072,776 A * 1/1963 Quenneville ..... A47G 9/023 219/212
3,134,110 A * 5/1964 Gamichon ..... A47G 9/0207 5/498
4,074,375 A * 2/1978 Kella ..... A47G 9/04 5/494
4,653,131 A * 3/1987 Diehl ..... A47C 21/08 128/872
5,263,212 A * 11/1993 Garcia ..... A47G 9/0246 5/496
5,287,573 A * 2/1994 Ritacco ..... A47G 9/0238 5/486
D376,720 S * 12/1996 Thode ..... D6/603
6,389,621 B1 * 5/2002 Elliott ..... A47G 9/0246 5/486
7,100,223 B1 * 9/2006 Anthony ..... A47G 9/02 5/482
7,971,293 B1 * 7/2011 Helton ..... A47G 9/023 5/486
8,214,947 B1 * 7/2012 Helton ..... A47G 9/023 5/486

(Continued)

*Primary Examiner* — Eric J Kurilla
(74) *Attorney, Agent, or Firm* — Boudwin Intellectual Property; Daniel Boudwin

(57) ABSTRACT

A split bed skirt is provided. The device includes a flexible planar body having a central slit that extends from a first edge of the body towards an opposing second edge. The central slit is adapted to be positioned at a split in a split bed system. The planar body includes a skirt extending around the perimeter of the body. In use, the planar body is positioned between a mattress and a box frame, or other mattress support, such that the skirt extends downwardly around the perimeter of mattress support to the ground. The slit allows independent movement of the individual sides of the split bed system without moving the bed skirt portion. The body includes a plurality of straps that secure the body to the mattress support.

13 Claims, 3 Drawing Sheets

(56) References Cited

U.S. PATENT DOCUMENTS

| | | | | |
|---|---|---|---|---|
| 8,522,378 | B2 | 9/2013 | Argento | |
| 9,179,790 | B2 * | 11/2015 | Messina | A47G 9/023 |
| 2003/0121100 | A1 * | 7/2003 | Fabian | A47G 9/0284 5/486 |
| 2006/0031987 | A1 * | 2/2006 | Stanfield | A47G 9/0207 5/486 |
| 2007/0061967 | A1 * | 3/2007 | Fox | A47G 9/023 5/486 |
| 2008/0313809 | A1 * | 12/2008 | Inman, II | A47G 9/0207 5/486 |
| 2009/0044336 | A1 | 2/2009 | Jackson | |
| 2009/0249547 | A1 * | 10/2009 | Lee | A47G 9/0207 5/400 |
| 2011/0252563 | A1 * | 10/2011 | Horstman | A47G 9/0207 5/486 |
| 2011/0289686 | A1 | 12/2011 | Chose | |
| 2012/0246828 | A1 * | 10/2012 | Argento | A47G 9/02 5/486 |
| 2013/0014325 | A1 * | 1/2013 | Argento | A47G 9/062 5/417 |
| 2013/0014326 | A1 | 1/2013 | Kane et al. | |
| 2014/0259419 | A1 * | 9/2014 | Stusynski | A47C 31/008 5/618 |
| 2016/0166091 | A1 | 6/2016 | Carlson et al. | |
| 2018/0279813 | A1 * | 10/2018 | Romez | A47G 9/02 |
| 2020/0060448 | A1 * | 2/2020 | Boesch | A47G 9/0246 |
| 2020/0260886 | A1 * | 8/2020 | Chen | A47G 9/02 |

* cited by examiner

SPLIT BED SKIRT

CROSS REFERENCE TO RELATED APPLICATIONS

This application claims the benefit of U.S. Provisional Application No. 62/910,612 filed on Oct. 4, 2019. The above identified patent application is herein incorporated by reference in its entirety to provide continuity of disclosure.

BACKGROUND OF THE INVENTION

The present invention relates to bed skirts. More particularly, the present invention provides for a split bed skirt that can be disposed on a split bed system such that when one side of the split bed system is raised or lowered, the skirt remains in position and is not pulled by the raising or lowering side of the split bed system.

Many people utilize split bed systems as they offer increased comfort and customization options to occupants. Typically, a split bed system is divided into two halves, each half being sized to accommodate a single individual. A head section and a leg section of each half of the split bed system can be independently raised and lowered. Such independent movement and adjustability enables one individual in the bed to adjust the angle of their half of the bed to a desired position, such as a partially reclined reading position, while enabling a neighboring individual on a second half of the split bed system to be in a different position, such as lying down to sleep.

Traditional split bed systems use traditional sizes of sheets, covers, duvets, and bed skirts. Bed skirts are utilized for a number of purposes such as to provide a barrier such that dust is prevented from accumulating underneath the bed, to hide items stored underneath the bed, and for decorative purposes. Traditional bed skirts are valances, or pieces of fabric, that are secured between the mattress and the box spring of a bed and hang down such that they touch the floor surface. A bed skirt is typically one continuous piece of fabric that hangs down around the perimeter of the bed and is sandwiched between the mattress and box spring, or mattress and platform. Such traditional bed skirts cannot be used in a split bed system as the split bed system includes a platform with an adjustable base that can be raised or lowered. If a standard bed skirt were used on a split bed system, whenever either side of the platform was raised or lowered the bed skirt would get stretched. This would result in the bed skirt being pulled out of position and defeating the purpose of the bed skirt. Some people utilize a wraparound member, or secure lengths of material to the edge of the bed frame to present a bed skirt, but such workarounds are either easily pulled out of place, or do not present the desired clean aesthetic of a standard bed skirt.

The present invention substantially diverges in design elements from the known art and consequently it is clear that there is a need in the art for an improvement to existing bed skirts. In this regard the present invention substantially fulfills these needs.

SUMMARY OF THE INVENTION

In view of the foregoing disadvantages inherent in the known types of bed skirts now present in the art, the present invention provides a split bed skirt that can be disposed on a split bed system such that when one side of the split bed system is raised or lowered, the skirt remains in position and is not pulled by the raising or lowering side of the split bed system. The present split bed skirt comprises a flexible planar body having a central slit that extends from a first edge of the body towards an opposing second edge. The central slit is adapted to be positioned at a split in a split bed system. The planar body includes a skirt extending around the perimeter of the body. In use, the planar body is positioned between a mattress and a box frame, or other mattress support, such that the skirt extends downwardly around the perimeter of mattress support to the ground. The slit allows independent movement of the individual sides of the split bed system without moving the bed skirt portion. The body includes a plurality of straps that secure the body to the mattress support.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
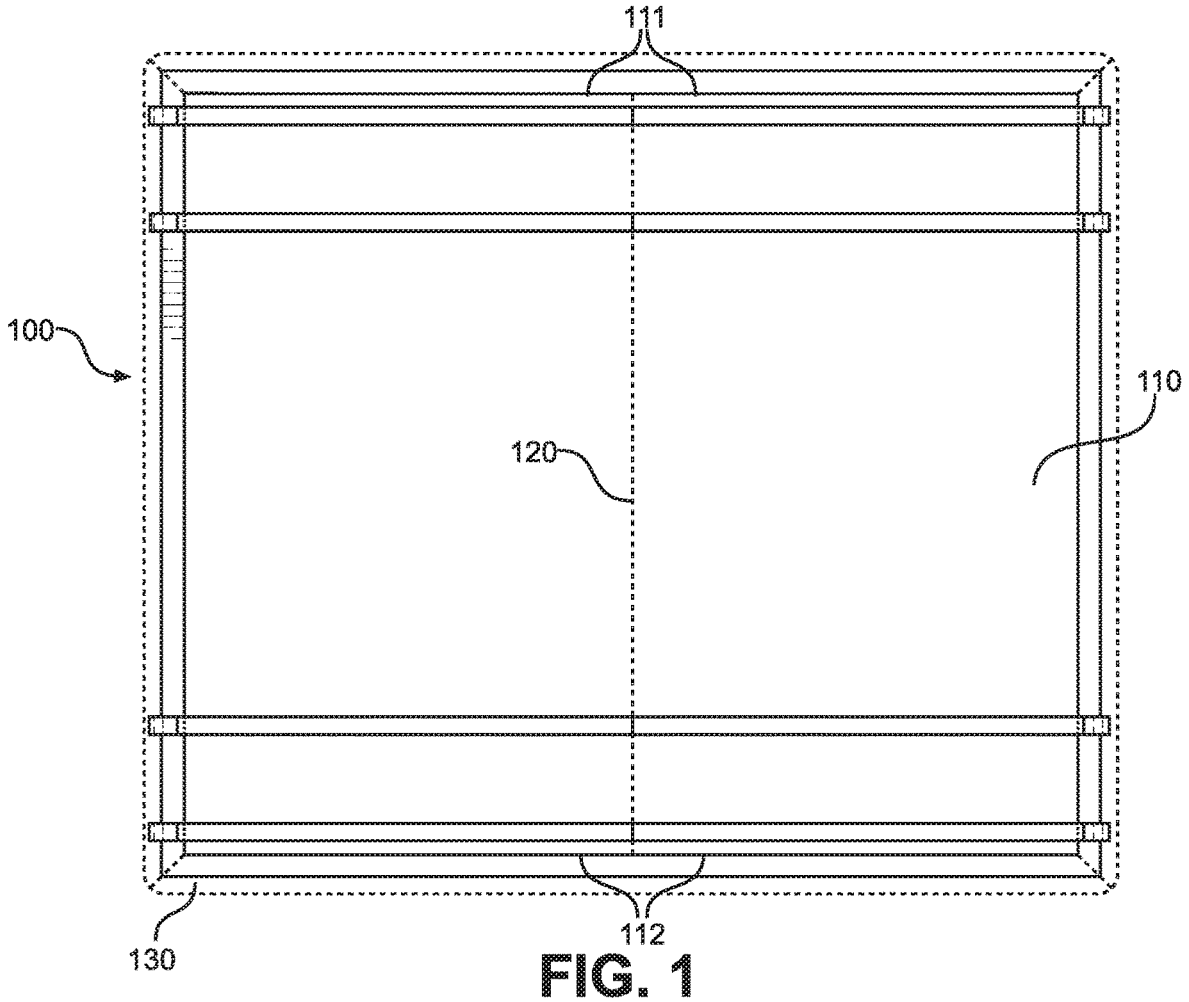
FIG. 1 shows a top-down view of an embodiment of the split bed skirt.

Reference is made herein to the attached drawings. Like reference numerals are used throughout the drawings to depict like or similar elements of the split bed skirt. For the purposes of presenting a brief and clear description of the present invention, a preferred embodiment will be discussed as used for the split bed skirt. The figures are intended for representative purposes only and should not be considered to be limiting in any respect.

Referring now to FIG. 1, there is shown a top-down view of an embodiment of the split bed skirt. The split bed skirt 100 comprises a planar body 110 including a central slit 120. The planar body 100 is adapted to fit between either a box frame and a mattress, or similar mattress supports and a mattress. In various embodiments, the planar body 110 is composed of a textile and a fabric in order to match or accompany a desired aesthetic of a slit bed system as a whole. In such embodiments, it is contemplated that the split bed skirt 100 can be easily removed from the split bed system in order to be washed or replaced. The planar body 110 is a thin flexible member such that it will not impede the mechanics of the split bed system as each individual component of the system is raised or lowered and will not unduly add a significant height to the split bed system as a whole. The flexible nature of the planar body 110, in combination with the textile or fabric material, makes the present invention easy to fold and store in a compact manner such that the split bed skirt 100 does not occupy a large volume of space.

The central slit 120 extends from a first edge 111 of the body 110 towards an opposing second edge 112. In the shown embodiment, the central slit 120 extends a full length of the body 110 such that the central slit 120 extends all the way from the first edge 111 to the second edge 112. In such embodiments, the body 110 is able to accommodate moving components of the split bed system including a lower section typically devoted to raising and/or lowering a user's legs. In other embodiments, the central slit 120 only extends a portion of the length from the first edge 111 to the second edge 112. In such embodiments, the body 110 can accommodate various lengths of the split bed system include an entirety and a portion of the lower section as well as an entirety and a portion of an upper section typically devoted to raising and/or lowering the user's torso and head. These various embodiments allow for a customizable length of the central slit 120 and provide the body 110 with greater strength and durability where the central slit 120 is smaller, and greater flexibility when the central slit 120 is larger.

Figure 5:
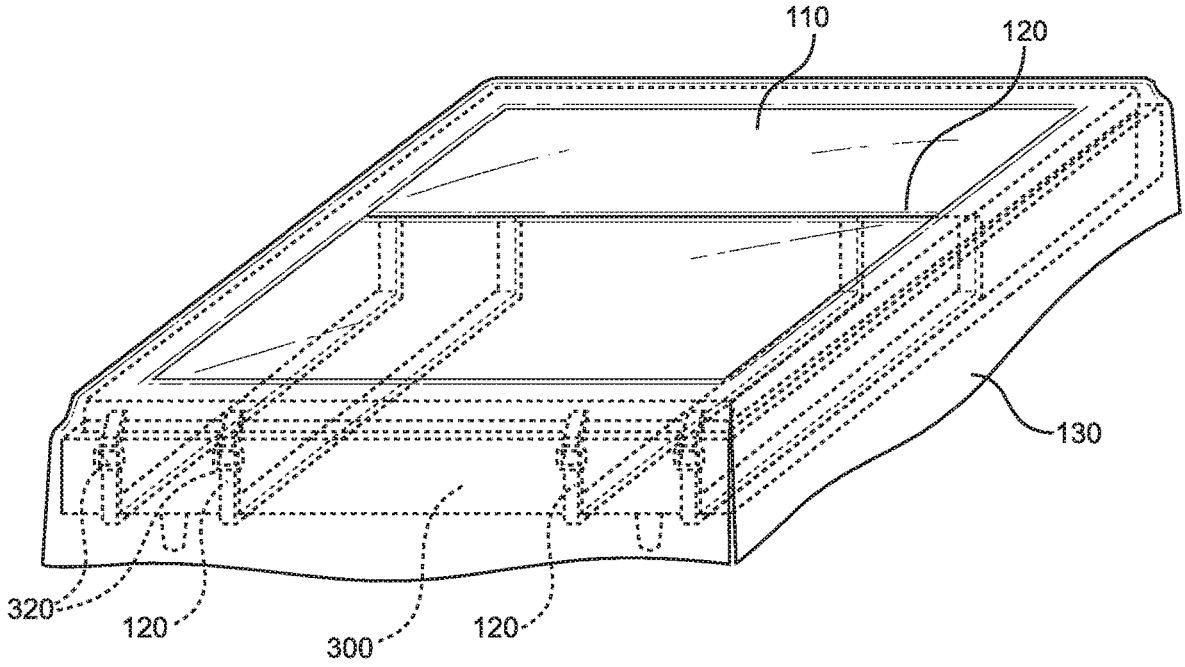
FIG. 5 shows a side perspective view of an embodiment of the split bed skirt in use.

The central slit 120 is adapted to be positioned at a split in the split bed system (as shown in FIG. 5). In the shown embodiment, the central slit 120 is disposed along a midline of the body 110. In this manner, equal portions of the body 110 are disposed on either side of the central slit 120. As split bed systems typically are composed of either two identical mattresses and mattress supports positioned side-by-side, or are designed to be sectioned into equal proportions, the placement of the central slit 120 along the midline of the body 110 enables the central slit 120 to line up with the gap between the sections or mattresses/mattress supports.

A skirt 130 extends around a perimeter of the body 110. In various embodiments, the skirt 130 is composed of a textile and a fabric similar to the body 110. In some embodiments, the skirt 130 comprises textures, designs, indicia, and the like to match or complement a desired aesthetic of the split bed system and associated bed sheets, comforters, linens, or other bed accessories. In one embodiment, the skirt 130 is sized to extend from a bottom of a mattress surface to a floor surface when the split bed skirt is secured to a split bed system. In this manner, drafts, dirt, dust and other undesirable elements are prevented from migrating beneath the split bed system as the skirt 130 provides a barrier that bars such undesirable elements from gaining access thereto. In some embodiments, the skirt 130 is a stiff material, such as a heavy cloth, to provide a more substantial barrier than thinner materials. In some embodiments, the skirt 130 is sized to extend from the bottom of the mattress to a position between half an inch to one inch above the floor surface when the split bed skirt is secured to a split bed system. In other embodiments, the skirt 130 is oversized in that the skirt 130 will extend beyond a length from the bottom of the mattress to the floor such that the skirt 130 will pool on the floor surface when the split bed skirt is secured to a split bed system. In some embodiments, the skirt 130 is disposed along an entire perimeter of the body 110. In other embodiments, the skirt 130 extends around a portion of a perimeter of the body 110. In one such embodiment, the skirt 130 extends around three of four sides, leaving the fourth side devoid of the skirt 130. Such a configuration can make adjustment of the skirt 130 easier and does not necessitate moving the split bed system away from a wall, for example, in order to install the split bed skirt.

Figure 2:
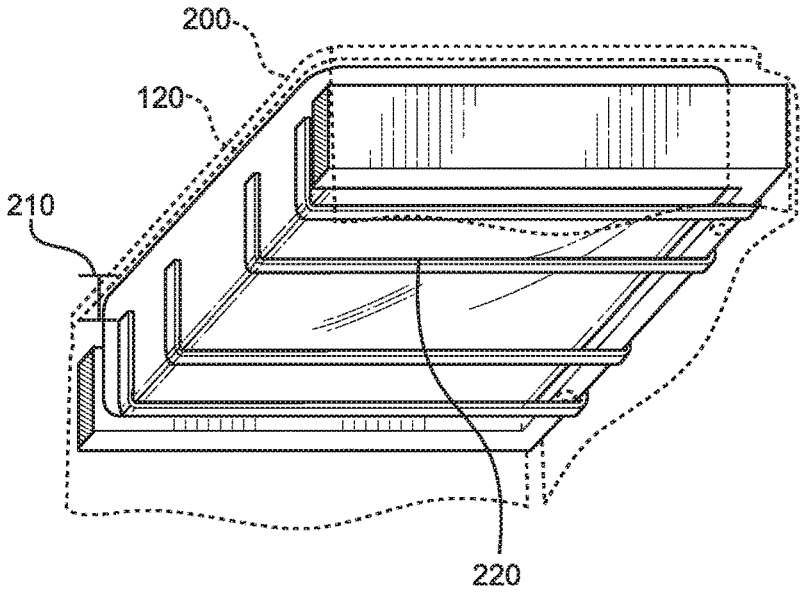
FIG. 2 shows a cross-sectional bottom-up view of an embodiment of the split bed skirt in use on one-half of a split bed system.

Referring now to FIG. 2, there is shown a cross-sectional bottom-up view of an embodiment of the split bed skirt in use on one-half of a split bed system. In some embodiments, a pair of seams 200 are disposed parallel to the central slit 120. A distance 210 between the pair of seams 200 and the central slit 120 enables a length of the body 110 to drape down into a gap between the mattresses in a split bed system. In use, an individual can position the central slit 120 over the gap between a pair of mattresses positioned side-by-side in a split bed system. The individual can then feed the portion of the body 110 surrounding the central slit 120 down the gap until the seams 200 line up with a top surface of the mattresses. In this manner, a length of the body 110 will drape down into the gap and surround a portion of a side of each of the mattresses. In one embodiment, the distance 210 between the pair of seams 200 and the central slit 120 is four inches in order to provide four inches of coverage of the sides of the mattresses in the gap.

In some embodiments, the split bed skirt further comprises a plurality of straps 220. The straps 220 can be utilized to secure the split bed skirt to a mattress base, box frame, or similar mattress support. In the shown embodiment, four straps 220 are attached to an edge of the body 110 forming the central slit 120. In the preferred embodiment, each of the plurality of straps 220 is connected to a side of the central slit 120 and a side edge of the planar body opposing the central slit 120. Further, in the preferred embodiment, each of the plurality of straps 220 is sized to wrap around a mattress support. In a further embodiment, each of the plurality of straps 220 is sized between twenty-one and forty-five inches in length in order to accommodate standard depths of at tress supports. In this manner, the straps 220 form a loop which can be utilized to surround the mattress support and thereby secure the split bed skirt thereon.

Figure 3:
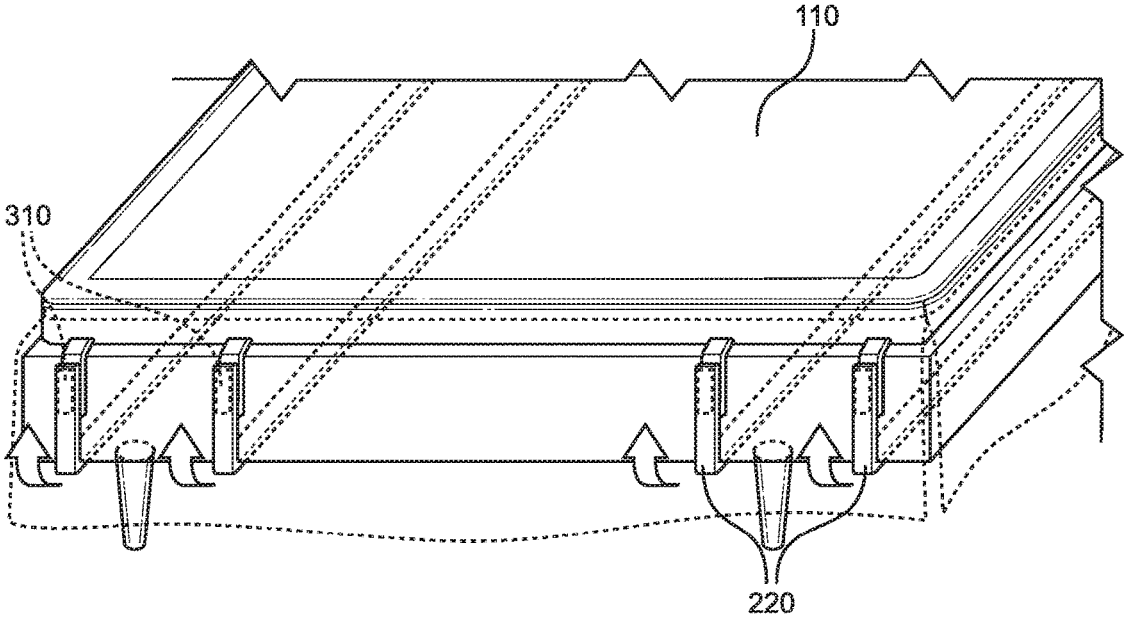
FIG. 3 shows a side view of an embodiment of the split bed skirt in use along a length of a mattress support.
Figure 4:
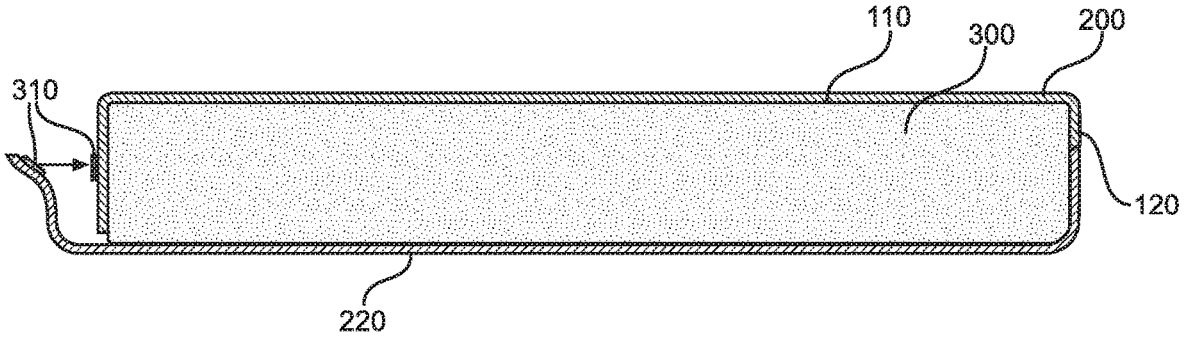
FIG. 4 shows a cross-section of an embodiment of the split bed skirt in use across a base of a mattress support.

Referring now to FIGS. 3 and 4, there are shown a side view of an embodiment of the split bed skirt in use along a length of a mattress support, and a cross-section of an embodiment of the split bed skirt in use across a base of a mattress support. In the shown embodiments, the split bed skirt is disposed over a mattress support 300. In some embodiments, each of the plurality of straps 220 further comprises a fastener 310. In the shown embodiment, the fastener 310 is hook and loop material, however, the present disclosure contemplates any suitable fasteners such as buttons, snaps, and the like. The plurality of straps 220 are fed down through a gap between a pair of mattresses and underneath the mattress support 300. The straps 220 are then fastened via the fastener 310, which is hook and loop material in the shown embodiment, in order to secure the split bed skirt in place. Hook and loop fasteners, in particular, are desirable as they enable a fast and easy mechanism for the straps 220 to attach and can be selectively adjusted to accommodate size and depth of the mattresses and mattress supports.

In the embodiment shown in FIG. 3, four pairs of straps 220 are disposed along a length of the central slit, such that two of the four pairs are disposed along a lower portion of the mattress support 300 and the remaining two pairs are disposed along an upper portion of the mattress support 300. In this manner, the length of the split bed skirt is securely attached to both moving components of the split bed system. By leaving a central portion of the body unencumbered by the straps 220, the body 110 is able to flex in response to the upper and lower portions of the mattress moving. Specifically, in the shown embodiment, no straps 220 are disposed over a portion of the body 110 which would line up with a pivotal portion of the mattresses.

In the embodiment shown in FIG. 4, each of the plurality of straps 220 is connected to a side of the central slit 120 and a side edge of the planar body 110 opposing the central slit 120. In the shown embodiment, the central slit 120 is four inches from the seam 200, thereby enabling four inches of the body 110 to hang down and reside in the gap between mattress supports 300. Further, in the preferred embodiment, each of the plurality of straps 220 is sized to wrap around the mattress support 300. In this manner, the straps 220 form a loop which can be utilized to surround the mattress support 300 and thereby secure the split bed skirt thereon. The fasteners 310, which are disposed on an inner edge of a distal end of each strap 220, in the shown embodiment, can be selectively adjusted to secure the split bed skirt to the mattress support 300, as shown.

Referring now to FIG. 5, there is shown a side perspective view of an embodiment of the split bed skirt in use. In use, an individual can position the planar body 110 over a top surface of a mattress support 300. A central slit 120 can be positioned to overlay a gap between mattresses, and in embodiments with a seam, the planar body 110 can be fed into the gap until the seam aligns with a bottom surface of a mattress. In this manner, a length of the planar body 110 can cover sides and edges of the mattress support 300. Straps 220 are fed down through the gap between the mattresses and underneath the mattress support 300. The straps 220 are then fastened via a fastener 320, which is hook and loop material in the shown embodiment, in order to secure the split bed skirt in place. A skirt 130 can then be folded down and positioned over a perimeter of the mattress support 300 such that a terminal edge of the skirt 130 can hang according to the desired aesthetics of the individual.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A split bed skirt, comprising:

a planar body including a central slit, wherein the central slit extends from a first edge of the body towards an opposing second edge;

the central slit adapted to be positioned at a split in a split bed system;

a plurality of straps;

wherein each of the plurality of straps is connected to a side of the central slit and a side edge of the planar body opposing the central slit; and a skirt extending around a perimeter of the body.

2. The split bed skirt of claim 1, further comprising a pair of seams, wherein each of the pair of seams are disposed along a line four inches from the central slit on opposing sides of the central slit.

3. The split bed skirt of claim 1, further comprising four pairs of straps.

4. The split bed skirt of claim 1, wherein each of the plurality of straps further comprises a fastener.

5. The split bed skirt of claim 1, wherein each of the plurality of straps is sized to wrap around a mattress support.

6. The split bed skirt of claim 1, wherein each of the plurality of straps is sized between twenty-one and forty-five inches in length.

7. The split bed skirt of claim 1, wherein the skirt is sized to extend from a bottom of a mattress surface to a floor surface when the split bed skirt is secured to a split bed system.

8. The split bed skirt of claim 1, wherein the planar body is flexible.

9. The split bed skirt of claim 1, wherein the planar body is composed of a textile.

10. The split bed skirt of claim 1, wherein the planar body is composed of a fabric.

11. A split bed skirt, comprising:

a planar body including a central slit, wherein the central slit extends from a first edge of the body towards an opposing second edge;

the central slit adapted to be positioned at a split in a split bed system;

four pairs of straps;

wherein each of the four pairs of straps is connected to a side of the central slit and a side edge of the planar body opposing the central slit; and a skirt extending around a portion of a perimeter of the body.

12. The split bed skirt of claim 11, further comprising a pair of seams, wherein each of the pair of seams are disposed along a line four inches from the central slit on opposing sides of the central slit.

13. The split bed skirt of claim 11, wherein the skirt is sized to reach from a bottom of a mattress surface to a floor surface when secured to a split bed system.

* * * * *